US005356017A

United States Patent [19]

Rohr et al.

[11] Patent Number: 5,356,017

[45] Date of Patent: Oct. 18, 1994

[54] CHILD RESISTANT CLOSURE WITH RECESSED LATCH

[75] Inventors: Robert D. Rohr, Eagle; Leo R. Imbery, Jr., Mukwonago; Richard J. Daniels, Caledonia, all of Wis.

[73] Assignee: AptarGroup, Inc., Crystal Lake, Ill.

[21] Appl. No.: 967,759

[22] Filed: Oct. 28, 1992

[51] Int. Cl.[5] ..... B65D 55/02

[52] U.S. Cl. ..... 215/216; 215/245; 220/335; 220/339

[58] Field of Search ..... 215/211, 213, 216–225, 215/237, 244, 245; 220/335, 339, 326

[56] References Cited

U.S. PATENT DOCUMENTS

| | | | |
|---|---|---|---|
| 3,869,057 | 3/1975 | Miller . | |
| 4,002,275 | 11/1975 | Crowle et al. . | |
| 4,022,352 | 5/1977 | Pehr . | |
| 4,065,035 | 12/1977 | Eissler . | |
| 4,127,221 | 11/1978 | Vera . | |
| 4,170,315 | 10/1979 | Dubach et al. . | |
| 4,353,483 | 10/1982 | Pehr | 215/216 X |
| 4,722,449 | 2/1988 | Dubach | 215/235 |
| 4,787,526 | 11/1988 | Pehr . | |
| 4,809,874 | 3/1989 | Pehr | 215/237 X |
| 4,852,770 | 8/1989 | Sledge et al. | 215/216 X |
| 4,854,473 | 8/1989 | Dubach | 220/335 |
| 4,925,041 | 5/1990 | Pehr . | |
| 5,013,073 | 5/1991 | Pehr . | |
| 5,031,784 | 7/1991 | Wright | 215/216 |
| 5,040,691 | 8/1991 | Hayes et al. | 215/216 |
| 5,065,911 | 11/1991 | Rohr et al. | 215/235 X |
| 5,092,493 | 3/1992 | Pehr | 215/216 X |
| 5,096,077 | 3/1992 | Odet et al. | 215/235 X |
| 5,137,260 | 8/1992 | Pehr . | |
| 5,147,054 | 9/1992 | Pehr | 215/253 |

OTHER PUBLICATIONS

"Devices That Protect Products", Shellvick Industries, Inc. publication, Sep. 1991.

"Automatic Recess Latch Closure", Shellvick Industries, Inc. publication, Feb. 1991.

"Automatic Reset Window Sash Lock", Shellvick Industries, Inc. publication, no date.

Two sheets of photographs A–G.

*Primary Examiner*—Allan N. Shoap

*Assistant Examiner*—Stephen Cronin

*Attorney, Agent, or Firm*—Dressler, Goldsmith, Shore & Milnamow, Ltd.

[57] ABSTRACT

A child-resistant closure is provided with a base having a deck with a discharge aperture. A lid having a bottom surface for engaging the base is hingedly connected to the base. The base has a resilient locking lever that projects the base deck at a location inwardly of the periphery of the base. The lever defines a shoulder. The lid has a central cover panel defining an aperture inwardly of the periphery of the lid for receiving the lever when the lid is closed. The lid defines a latch surface adjacent the aperture for confronting the base lever shoulder when the lid is closed. The periphery of the lid defines a finger-engaging surface laterally offset relative to the lid aperture, and the finger-engaging surface extends progressively outwardly with increasing distance from the lid bottom surface. The portion of the base that extends from the hinge connection is configured to project peripherally outwardly at least as far as the lid bottom surface when the lid is closed. The portion of the lid periphery that extends from the hinge connection is free of overhanging peripheral surfaces of sufficient depth to be liftingly engaged by a child's teeth.

13 Claims, 2 Drawing Sheets

Fig. 1
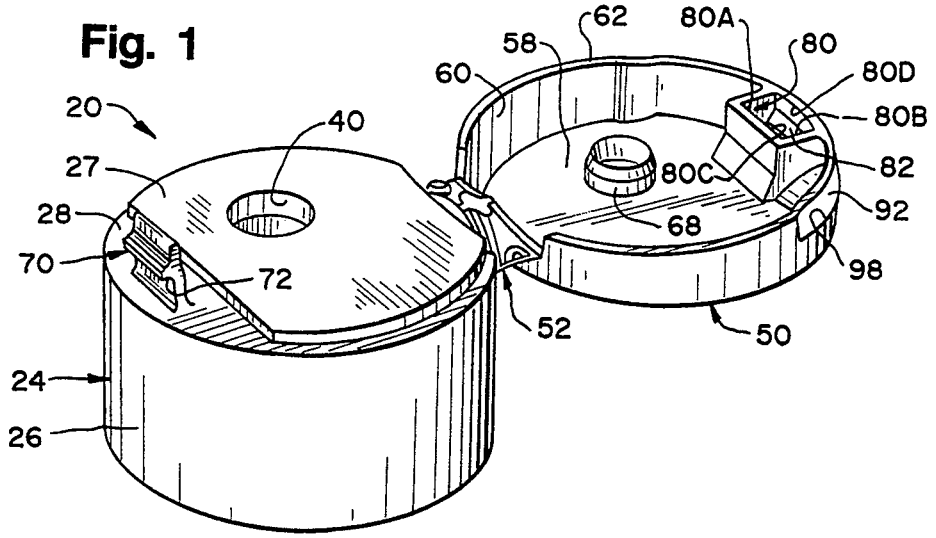
Fig. 2
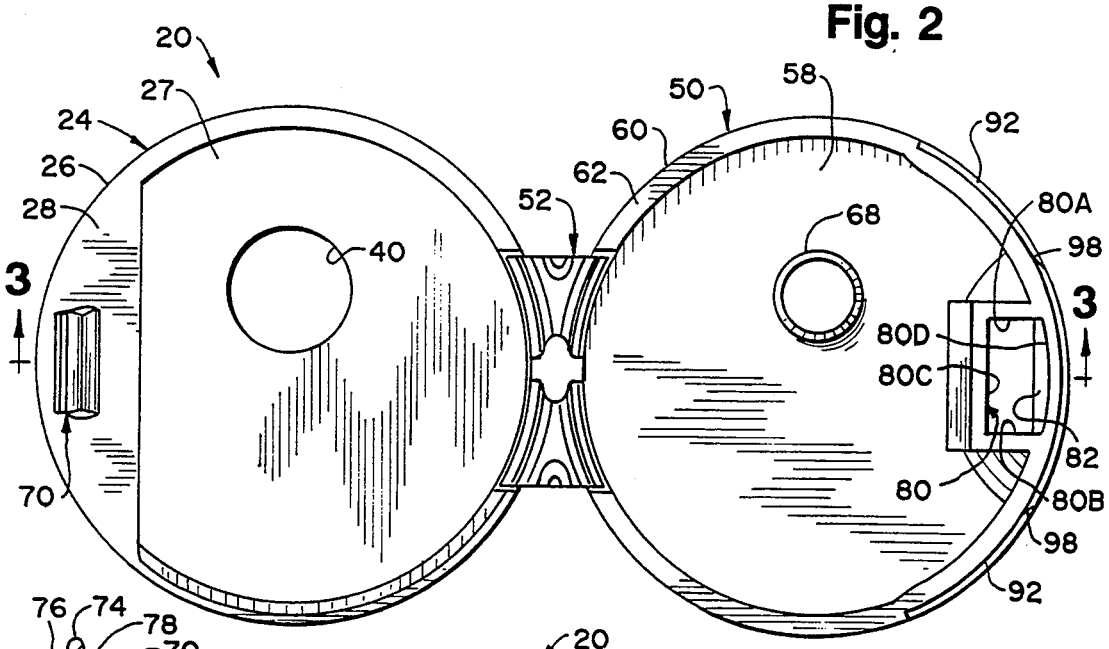
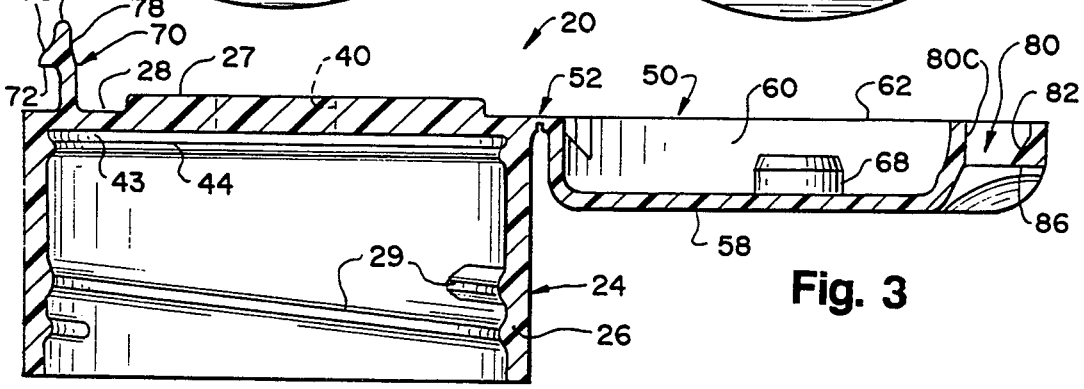
Fig. 3

Fig. 4
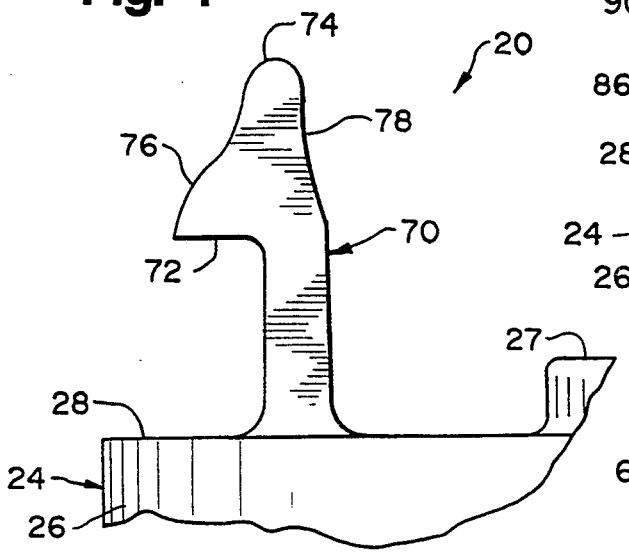
Fig. 6
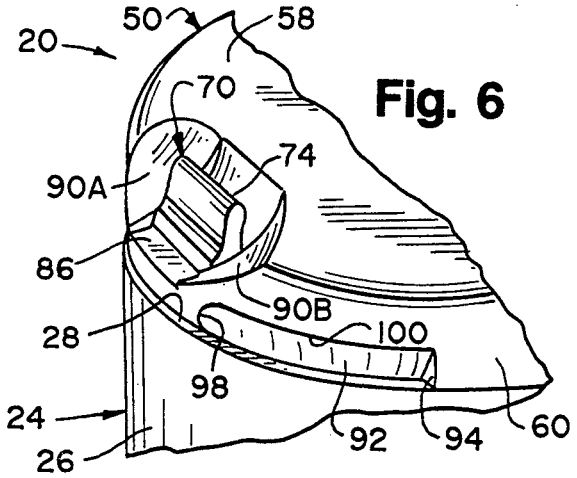
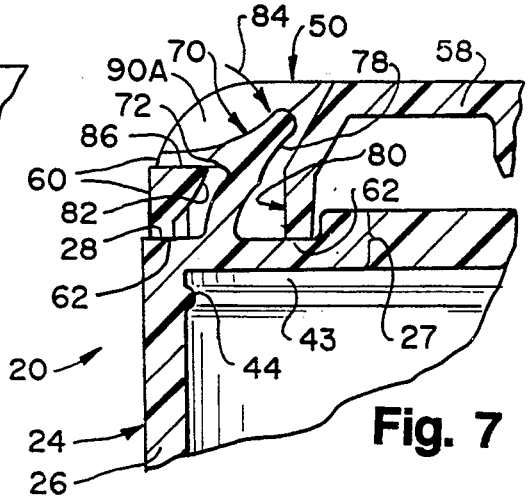
Fig. 7
Fig. 5
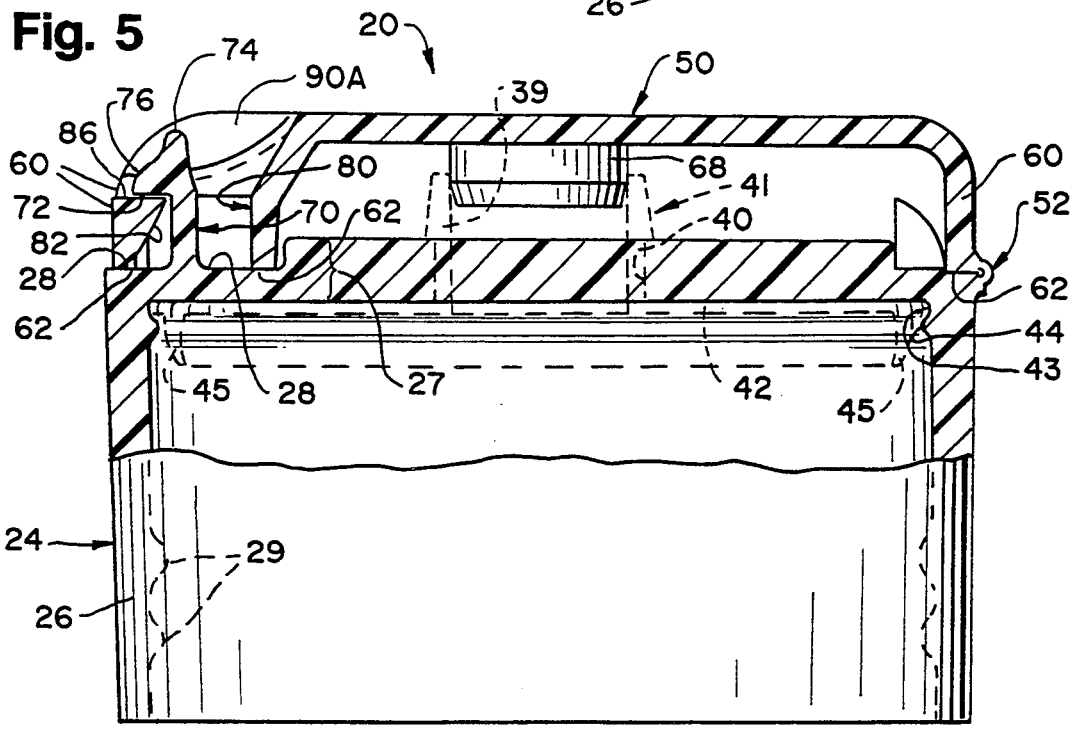

CHILD RESISTANT CLOSURE WITH RECESSED LATCH

TECHNICAL FIELD

This invention relates to a child resistant closure for a container, and more particularly to a closure which minimizes the likelihood that a child's teeth can be engaged with portions of the closure to distort the closure sufficiently to open the closure.

BACKGROUND OF THE INVENTION AND TECHNICAL PROBLEMS POSED BY THE PRIOR ART

In the United States of America, manufacturers of child resistant closures seek to provide closures that, under test protocols, meet or exceed the Consumer Products Safety Commission child resistant safety standards.

Some types of allegedly child resistant closures made from conventional thermoplastic materials can be permanently or temporarily deformed or distorted by a child's teeth. The present inventors have learned that a child may place part of such a closure in his or her mouth and engage a portion of the closure with the front top teeth and/or with the front bottom teeth. The child may also grasp, and push or pull, the portion of the closure or container projecting from the child's mouth.

If the closure has a ledge, shoulder, indentation, groove or the like at or near the periphery of the closure, the child's teeth can effectively engage such a formation and actually deform, distort, or otherwise pry a portion of the closure away from its normal locking engagement configuration. This has been found to occur even where the child does not otherwise attempt to also directly disengage a locking member which is designed to be moved to a release position by an adult user of the closure.

Thus, it would be desirable to provide an improved child resistant closure which can be more effective in defeating a child's attempt to open the closure.

Although exceptionally strong, child resistant closures can be designed, such closures may not be commercially acceptable owing to high cost, lack of aesthetic appeal, and the difficulty of opening such closures by adults. Therefore, it would be advantageous to provide an improved closure with increased child resistance features that are not too difficult or cumbersome for adult users and that do not significantly detract from the aesthetic appeal of the closure.

It would also be beneficial if such an improved closure could be provided in the form that would not require excessively complicated manufacturing operations and that would permit the use of conventional, high-speed, automatic capping machines for applying the closures to containers.

The present invention can be embodied in designs that provide one or more of the above-discussed benefits and features.

SUMMARY OF THE INVENTION

The present invention provides a child resistant closure offering advantages of greater aesthetic appeal, improved child resistance, easier manufacturing, and better compatibility with high-speed, automatic capping machines.

The closure includes a base or body for attachment to the container. The base includes a deck defining a discharge aperture communicating with the container. A lid having a bottom surface for engaging the base is hingedly connected to the base for movement between open and closed positions.

The base has a resilient locking lever that projects from the base deck at a location inwardly of the periphery of the body and that defines a shoulder.

The lid has a central cover panel defining an aperture inwardly of the periphery of the lid for receiving the lever when the lid is closed to reduce the exposure of the lever to engagement with a child's teeth. The lid panel defines a latch surface adjacent the aperture for confronting the base lever shoulder when the lid is closed.

The periphery of the lid defines a finger-engaging surface laterally offset relative to the lid aperture. The engaging surface extends progressively outwardly with increasing distance from the lid bottom surface. This allows a user to apply an opening force to the engaging surface with a finger while simultaneously applying a force to the distal end of the lever with another finger to bend the lever away from the latch surface to accommodate movement of the lid from the closed position.

The portion of the base that extends from the hinge connection is configured to project peripherally outwardly at least as far as the lid bottom surface when the lid is closed. Further, the portion of the lid periphery that extends from the hinge connection is free of overhanging peripheral surfaces of sufficient depth to be liftingly engaged by a child's teeth positioned for pushing the lid in the closed position away from the base.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 is a perspective view of the closure of the present invention shown in a fully open, as molded, dispensing orientation;

FIG. 2 is an enlarged plan view of the closure;

FIG. 3 is a cross-sectional view taken generally along the plane 3—3 in FIG. 2;

FIG. 4 is a greatly enlarged, fragmentary, side elevational view of the locking lever of the closure base;

FIG. 5 is an enlarged, side elevational view, taken partly in cross section, of the closure in the locked closed orientation;

FIG. 6 is a fragmentary, perspective view of the front of the closure showing the latching and opening features; and FIG. 7 is a fragmentary view similar to FIG. 5 showing the locking lever in a temporarily deflected position to permit opening of the closure lid.

DESCRIPTION OF THE PREFERRED EMBODIMENTS

While this invention is susceptible of embodiment in many different forms, this specification and the accompanying drawings disclose only one specific form as an example of the invention. The invention is not intended to be limited to the embodiment so described, however.

The scope of the invention is pointed out in the appended claims.

For ease of description, the closure of this invention is described in an upright position, and terms such as upper, lower, horizontal, etc., are used with reference to this position. It will be understood, however, that the closure of this invention may be manufactured, stored, transported, used, and sold in an orientation other than the position described.

FIG. 1 shows an embodiment of the child resistant closure of the present invention in a fully opened, as molded, dispensing orientation wherein the closure is represented generally by reference numeral 20. The closure 20 is adapted to be mounted on a container (not illustrated) which may have a conventional open mouth defined by a neck (not illustrated) or other suitable structure.

The closure 20 includes a closure base or body 24 for securement to the container. The base 24 includes a generally cylindrical, peripheral wall 26 and a generally transverse closure wall or deck 28 (FIGS. 1–4 and 5) which extends across the base 24. A central portion 27 of the base deck 28 is thicker so that the surrounding portion of the deck 28 defines a peripheral shoulder.

The cylindrical wall 26 of the closure base 24 is adapted to engage the outer periphery of the top of the container neck (not illustrated) around the container mouth, as with threads 29 (FIG. 3). Other suitable engaging means (e.g., snap-fit beads) may be provided to secure the closure base 24 on the container. Alternatively, in some applications the closure base 24 could be non-releasably attached to, or formed unitary with, the container.

The closure base 24 includes a discharge passage 40 through the deck 28 as best illustrated in FIGS. 1, 2, and 5. In a presently contemplated product, the closure passage 40 may be optionally oversized to accommodate the hollow discharge tube 39 of an insert member 41 (shown in phantom with dashed lines only in FIG. 5). The tube 39 projects upwardly through the passage 40 from a flange 42 which is disposed under the body deck 28 and secured thereto in a groove 43 defined by a bead 44 on the inside of the body skirt 26 below the deck 28. The insert 41 also includes a downwardly projecting, conventional, sealing ring 45 for engaging an interior edge of the container neck at the container mouth to effect a tight seal. The use of such an insert 41 is an optional design feature of a closure. The optional insert feature forms no part of the present invention.

A lid 50 is hingedly connected by a hinge means or hinge 52 to the edge of the base 24. The lid 50 is adapted to be pivoted between (1) a closed position (FIG. 5) preventing flow of the container-stored contents through the closure and (2) an open position (FIGS. 1–3) moved away from the closed position permitting the dispensing of the container-stored contents from the base discharge aperture.

The lid 50 is shown in FIGS. 1–3 in a fully opened, as molded, position. However, it will be appreciated that the lid 50 need not be moved to the completely open position in order to permit access to the container interior and the dispensing of the container contents.

In the preferred embodiment illustrated, the hinge 52 is a snap-action hinge of the conventional type described in the U.S. Pat. No. 4,403,712. It is not required that the hinge 52 be a snap-action type hinge. Any suitable hinge system may be employed for connecting the lid 50 to the base 24 consistent with the particular application requirements, aesthetics, manufacturing techniques, etc.

Preferably the lid 50 and the closure body 24 are molded as a unitary structure from suitable thermoplastic materials, such as polypropylene or polyethylene. However, the lid 50 and body 24 could be formed as separate pieces for subsequent assembly with a suitable connecting hinge system to permit opening and closing of the lid. The detailed design and operation of the hinge per se form no part of the present invention.

The lid 50 preferably includes a central cover panel 58 and has a peripheral skirt 60 depending from the periphery of the central cover panel 58. The lid skirt 60 (FIGS. 1–3) has a bottom surface 62 defining a bottom surface of the lid. The skirt bottom surface 62 is adapted to rest on the peripheral, annular shoulder of the base deck 28 when the lid is closed as illustrated in FIG. 5.

In the illustrated embodiment, the lid 50 also includes a sealing spud or member 68 (FIGS. 1–3 and 5) which projects from the central cover panel 58. The sealing member 68 is adapted to enter into the discharge opening of the hollow tube 39 projecting upwardly through base central deck region 27 when the lid 50 is closed (FIG. 5). This is particularly suitable for use with containers of liquids.

It will be appreciated, however, that the base discharge tube 39 and lid sealing member 68 need not be provided in the form illustrated, or need not be provided at all. If the closure 20 is used with liquids, then other means for sealing the closure lid 50 and base 24, as around the lid skirt bottom surface 62, may be employed. If the closure 20 is designed for a container for pills or other individual items, then a major portion of the base deck central portion 27 may be eliminated in order to provide a relatively large access opening to the container. In such a case, the discharge tube 39 and lid sealing member 68 would, of course, be eliminated.

A novel latching mechanism is provided for maintaining the lid 50 in the closed position and inhibiting a child from opening the closure. Specifically, at the front of the closure 20, diametrically opposite from the hinge 52, the base 26 has a resilient locking lever 70 which projects upwardly from the base deck 28 at a location inwardly of the periphery of the base. The locking lever 70 has an outwardly extending, and downwardly facing, shoulder 72. The lever 70 is relative stiff, and a small child would find it difficult, if not impossible, to use a finger to bend or deflect the locking lever 70 rearwardly toward the hinge 52.

The top of the locking member 70 has a curved distal end 74, and the front region of the locking member 70 above the shoulder 72 extends outwardly, in a slightly convex curve, from the thinner distal end to the outer edge of the shoulder 72. This defines a camming surface 76 against which the lid 50 acts as explained hereinafter. The lever 70 also has an inwardly concave, upper, rear surface 78 (FIG. 4) which provides clearance when the lever 70 is deflected rearwardly as described hereinafter.

The lid central cover panel 58 defines an aperture 80 (FIGS. 1–3) inwardly of the periphery of the lid for receiving the lever 70 when the lid is closed (FIG. 5). The bottom of the aperture 80 opens at the bottom surface of the lid (i.e., lid skirt bottom surface 62).

The aperture 80 has four sides. As can be seen in FIGS. 1 and 2, the aperture 80 has two opposed, planar, end walls 80A and 80B and a planar, rear wall 80C which is perpendicular to the end walls 80A and 80B.

The aperture 80 also has a curved lower front wall 80D which rises a short distance from the lid skirt bottom surface 62.

At the top of the lower front wall 80D, the aperture 80 becomes narrower owing to an inwardly slanting, planar, upper front wall 82. The surface 82 acts as a camming surface for engaging the lever camming surface 76 as the lid 50 is pivoted downwardly to the fully closed position. As the camming surfaces 82 and 76 engage, the lever 70 is deflected rearwardly, in the direction of the arrow 84 as shown in FIG. 7, to accommodate movement of the lid 50 to the fully closed position wherein the lid skirt seating surface 62 engages the base deck 28. As the lever 70 bends rearwardly, clearance is enhanced by the concave rear surface 78 on the back of the lever 70.

The lid camming surface 82 terminates at a horizontally disposed latch surface 86 at an elevation slightly below the elevation of the downwardly facing shoulder 72 on the lever 70. Thus, when the lid 50 is fully seated in the closed position, the lever 70 returns to its normal, undeflected position owing to the inherent resiliency of the lever material. When the locking lever 70 has returned to the normal, unstressed position illustrated in FIG. 5, the locking lever shoulder 72 overlies the lid latch surface 86 and prevents the lid 50 from being pivoted upwardly unless the locking lever 70 is first pivoted rearwardly.

When the lid 50 is fully closed as illustrated in FIG. 5, the top surface of the lid on either lateral side of the lever 70 is at an elevation slightly greater than the top of the lever distal end 74. The clearance around the top of the lever 70, and the overall width of the lever 70, are relatively small. This reduces the exposure of the lever 70 to engagement with a child's teeth and inhibits efforts of a child to bend the lever 70 rearwardly. Further, the small clearance around the lever 70 inhibits the insertion of a child's teeth under the lever shoulder 72.

However, in order to facilitate opening of the closure by an adult user, the lid 50 defines a finger access recess around, and extending from the aperture, and the recess is defined in part by two, spaced-apart, concave, curved surfaces 90A and 90B (FIG. 6). The surfaces 90A and 90B accommodate the width of a typical adult finger so that an adult can position a finger adjacent the upper front portion of the locking lever 70 and push the locking lever 70 rearwardly (in the direction of the arrow 84 illustrated in FIG. 7). However, the overall extent of the depth and width of the adjacent surfaces 90A and 90B are relatively small so as to reduce the exposure of the lever 70 to engagement with a child's teeth and so as to inhibit efforts of a child to bend the lever 70 rearwardly.

Further, as illustrated in FIG. 5, the top of the locking lever distal end 74 is preferably recessed slightly below the top of the adjacent central cover panel 58 of the lid. Further, as can be seen in FIG. 5, the peripheral region of the lid 50, including the skirt 60, extends outwardly beyond the front of the locking lever 70 to prevent a child's teeth from engaging the front of the lever 70.

To assist an adult user in opening the closure, the lid 50 includes a pair of spaced-apart, finger-engaging surfaces 92 (FIGS. 2 and 6). The finger-engaging surfaces 92 are defined in the skirt lid 60 by spaced-apart indentations. The indentations are each laterally offset relative to the lid aperture 80. Each indentation is defined at one end by an inwardly extending surface 94 (FIG. 6), and each finger-engaging surface 92 forms an outwardly facing, smooth wall defining a rear portion of the indentation.

Preferably, each indentation and associated finger-engaging surface 92 extends completely to the skirt bottom surface 62 but terminates short of the top of the skirt. Further, the end of each finger-engaging surface 92 opposite the indentation end wall 94 merges with the lid skirt 60, as at 98 (FIG. 6).

In order to permit the adult user's finger to exert an upper, opening force on the lid 50, each finger-engaging surface 92 extends progressively outwardly with increasing distance from the lid bottom surface 62 as can be seen in FIG. 6. The finger-engaging surface 92 terminates along a top edge 100 (FIG. 6) which extends forwardly or outwardly of the lid skirt bottom edge. However, but the finger-engaging surface 92 is free of overhanging peripheral surfaces of a depth sufficient to be liftingly engaged by a child's teeth. That is, the indentation is sufficiently shallow and slopped or curved so that the child's upper or lower front teeth cannot effectively engage, in a non-slipping manner, the surface 92 and apply sufficient force in the direction needed to pry the lid 50 away from the base 24.

Further, the other portions of the lip periphery between the two finger-engaging surfaces 92 and between each surface 92 and the hinge 52 are free of overhanging peripheral surfaces of sufficient depth to be liftingly engaged by a child's teeth.

In order to increase the child resistance of the closure 20, the finger-engaging recesses 92 do not extend in front of the region of the locking lever 70. That is, the lift area presented by each finger-engaging surface 92 is laterally displaced from the locking lever 70 and aperture 80 by an amount sufficient to require the user to perform the opening manipulations at two distinctly different locations on the closure in order to open the lid. Thus, the locking lever 70 must be engaged at one location on the lid 50, and while the locking lever is deflected, the lid 50 must be opened by lifting at one or both of the separated, laterally displaced, finger-engaging surfaces 92. This manipulation sequence is difficult and confusing for small children.

Preferably, the surface of skirt 60 immediately below the latch surface 86 between the finger-engaging surfaces 92 is substantially vertical and smooth, and is somewhat forward of the locking lever shoulder 72, so as to eliminate or reduce the presence of surfaces or edges that could be engaged by a child's teeth to separate or distort the structures in the region of the locking lever 70.

In addition, the portion of the base 24 that extends from the hinge 52 is configured to project peripherally outwardly at least as far as the lid bottom surface 62. Preferably, the base 24 extends peripherally outwardly further than the lid skirt bottom surface 62 as illustrated in FIG. 5. Because the base 24 normally projects beyond the closed lid 50, the closure has a larger range of manufacturing (molding) tolerances. That is, the molding of a slightly larger lid would still not result in the lid projecting peripherally beyond the base 24 so as to create an overhanging ledge that could be engaged by a child's teeth. Thus, the closure has the capability for more easily accommodating manufacturing processes.

Further, the closure can be molded with substantially no significant peripheral projections. Thus, the closure can be readily applied to a container with a conventional high-speed, automatic capping machine.

The closure of the present invention provides improved child resistance with more aesthetic appeal. Because the preferred embodiment of the closure has an inset latch structure and a lid free of overhanging peripheral surfaces with a depth sufficient to be engaged by a child's teeth, the lid is highly resistant to being pried open by a child's teeth. The smooth contours of the lid in the finger lift areas and in the locking lever area eliminate sharp edges and ledges so as to prevent a child's teeth from effectively engaging the closure in a manner that could deform and distort the closure to permit opening.

Further, the recess area around the locking lever is configured so that if a child bites down on the top, front portion of the lid 50, then the child's teeth will only force the closure lid more tightly against the closure base. The front surface of the locking lever 70, with its smooth, curved contour, resists being effectively engaged by a child's teeth. On the other hand, engagement of the rear surface of the locking lever by some means, as with some external instrument inserted between the lever and lid, will serve only to push the locking lever further forwardly into a greater engagement with the lid.

It will be readily apparent from the foregoing detailed description of the invention and from the illustrations thereof that numerous variations and modifications may be effected without departing from the true spirit and scope of the novel concepts or principles of this invention.

What is claimed is:

1. A child resistant closure for an opening to a container interior, said closure comprising:

a base for attachment to said container and having a deck defining a discharge aperture;

a lid having a bottom surface for engaging said base;

a hinge connection for hingedly connecting said lid to said base for movement between open and closed positions;

said base having a periphery, said base having a portion extending from said hinge connection, said base having a resilient locking lever that projects from said base deck at a location inwardly of the periphery of said base and that defines a shoulder, said lever being deflectable in a rearward direction;

said lid having a periphery, said lid having a portion extending from said hinge connection, said lid defining an aperture inwardly of the periphery of said lid for receiving said lever when said lid is closed to reduce the exposure of the lever to engagement with a child's teeth, said lid defining a latch surface that is adjacent said aperture and that lies under said base lever shoulder when said lid is closed, said lid having an outwardly facing top surface, said lid defining a finger access recess around, and extending from, said aperture, said recess being adjacent said lid periphery to accommodate insertion of a finger from the side of said closure and against said locking lever, said recess increasing in lateral size with increasing distance away from said lid bottom surface, said finger access recess having smoothly curving lateral walls extending upwardly from said aperture to said top surface laterally of said aperture generally transversely of said rearward direction to (1) facilitate the slippage of a child's teeth on said closure and (2) limit the size of said recess thereby minimizing the engagement of a child's teeth with said lever, the periphery of said lid defining a finger-engaging surface laterally offset relative to said lid aperture and extending progressively outwardly with increasing distance from said lid bottom surface thereby to require the use of separate fingers to operate said lever and to lift said lid via said finger-engaging surface; and said portion of said base that extends from said hinge connection being configured to project peripherally outwardly at least as far as said lid bottom surface when closed and said portion of said lid periphery that extends from said hinge connection being free of overhanging peripheral surfaces of sufficient depth to be liftingly engaged by a child's teeth.

2. The closure in accordance with claim 1 in which said lid has two of said finger-engaging surfaces at spaced apart locations;

portions of the periphery of said lid define two, spaced-apart indentations, with each indentation being laterally offset relative to said lid aperture; and each said finger-engaging surface is an outwardly facing, smooth wall defining a portion of one of said indentations.

3. The closure in accordance with claim 2 in which said lid has a peripheral skirt depending from said central cover panel;

said lid skirt has a bottom surface defining said lid bottom surface;

each said indentation extends completely to said skirt bottom surface and terminates short of the top of the skirt.

4. The closure in accordance with claim 3 in which said skirt bottom surface defines a surface portion between said two indentations which is located inwardly of the periphery of said base when said lid is closed.

5. The closure in accordance with claim 1 in which said lever has a distal end; and said lever has an upper, front surface above said shoulder which is curved to resist being non-slippingly engaged by a child's teeth.

6. The closure in accordance with claim 1 in which said lid has a peripheral skirt depending from the periphery of said lid, said skirt having an upper peripheral edge; and said recess extends outwardly to the periphery of said lid thereby defining a notch in the upper peripheral edge of said lid.

7. The closure in accordance with claim 1 in which the bottom of said recess includes an upwardly open channel with a planar bottom defined by said latch surface and with opposing sides defined by two, spaced-apart, parallel surfaces extending generally perpendicular to said latch surface.

8. A child resistant closure for an opening to a container interior, said closure comprising:

a base for attachment to said container around said opening, said base having a deck defining a discharge aperture for communicating with said opening;

a lid that has a bottom surface for engaging said base and a hinge means for connecting said lid and base in (1) a closed position preventing flow of the container-stored contents through the closure and (2) an open position moved away from said closed position permitting the dispensing of the container-stored contents from said discharge aperture;

said base having a periphery, said base having a portion extending from said hinge means, said base having a resilient locking lever that projects from said base deck at a location inwardly of the periphery of said base and that defines a shoulder, said lever being deflectable in a rearward direction;

said lid having a periphery, said lid having a portion extending from said hinge means, said lid having a central cover panel defining an aperture inwardly of the periphery of said lid for receiving said lever when said lid is closed to reduce the exposure of the lever to engagement with a child's teeth, said lid panel defining a latch surface adjacent said aperture and that lies under said base lever shoulder when said lid is closed, said lid having an outwardly facing top surface, said lid defining a finger access recess around, and extending from, said aperture, said recess being adjacent said lid periphery to accommodate insertion of a finger from the side of said closure and against said locking lever, said recess increasing in lateral size transversely of said rearward direction with increasing distance away from said lid bottom surface, said said finger recess having:

(A) two, spaced-apart, concave, smoothly curving surfaces which define lateral walls of said recess extending upwardly from said lid aperture to said top surface laterally of said aperture generally transversely of said rearward direction to (1) facilitate the slippage of a child's teeth on said closure and (2) limit the size of said recess thereby minimizing the engagement of a child's teeth with said lever, and (B) a third surface slanting upwardly and rearwardly away from said aperture to said top surface behind said aperture to facilitate the slippage of a child's teeth on said closure, said lid top surface around said finger access recess projecting beyond said lever when said lid is closed, said aperture having a minimum depth sufficient to prevent a child's teeth from engaging said lid bottom surface when said lid is closed;

the periphery of said lid defining an indentation presenting an engaging surface laterally offset relative to said lid aperture, said engaging surface extending progressively outwardly with increasing distance from said lid bottom surface to allow a user to apply an opening force to said engaging surface with a finger while simultaneously applying a force to the distal end of said lever with another finger to bend said lever away from said latch surface to accommodate movement of said lid away from said closed position;

said portion of said base that extends from said hinge means being configured to project peripherally outwardly at least as far as said lid bottom surface when closed; and said portion of said lid periphery that extends from said hinge means being free of exposed overhanging peripheral surfaces of sufficient depth to be liftingly engaged by a child's teeth for prying said lid and base apart from the closed position.

9. The closure in accordance with claim 8 in which said base has a depending cylindrical skirt with an internal thread for engaging a complementary mating thread on the exterior of a container neck around said opening.

10. The closure in accordance with claim 8 in which said lid has a peripheral skirt depending from said central cover panel.

11. The closure in accordance with claim 10 in which said lid skirt has a bottom surface defining said lid bottom surface; and said indentation extends completely to said skirt bottom surface and terminates short of the top of the skirt.

12. The closure in accordance with claim 10 in which said lid skirt defines two of said indentations spaced apart with each indentation being laterally offset relative to said lid aperture.

13. The closure in accordance with claim 12 in which said skirt bottom surface defines a surface portion between said two indentations which is located inwardly of the periphery of said base when said lid is closed.

* * * * *